United States Patent [19]

Llovera

[11] Patent Number: 4,961,838

[45] Date of Patent: Oct. 9, 1990

[54] TWO STEP PROCESS FOR THE OBTAINMENT OF WHITE OILS

[75] Inventor: Salvador A. Llovera, Avda. América, 50 - Madrid, Spain

[73] Assignee: Salvador A. Llovera, Madrid, Spain

[21] Appl. No.: 377,111

[22] Filed: Jul. 10, 1989

[51] Int. Cl.[5] ..... C10G 25/00

[52] U.S. Cl. ..... 208/91; 208/143; 208/144; 208/310 R

[58] Field of Search ..... 208/14, 119, 121, 143, 208/144, 310 R, 296, 91; 585/455, 829, 820

[56] References Cited

U.S. PATENT DOCUMENTS

| | | | |
|---|---|---|---|
| 2,475,328 | 7/1949 | La Lande | 502/410 |
| 3,328,293 | 6/1967 | Brenken | 208/143 |
| 3,392,112 | 7/1968 | Bercik et al. | 208/210 |
| 3,431,198 | 3/1969 | Rausch | 208/264 |
| 3,658,692 | 4/1972 | Gilbert et al. | 208/210 |
| 3,841,995 | 10/1974 | Bertolacini et al. | 208/89 |
| 4,240,900 | 12/1980 | Gilbert et al. | 208/264 |
| 4,318,829 | 3/1982 | Halluin et al. | 502/328 |
| 4,786,402 | 11/1988 | Anstock et al. | 208/268 |
| 4,810,355 | 3/1989 | Hopkins | 208/58 |

FOREIGN PATENT DOCUMENTS 708811 5/1965 Canada .

*Primary Examiner*—Curtis R. Davis
*Assistant Examiner*—William Diemler
*Attorney, Agent, or Firm*—Zarley, McKee, Thomte, Voorhees & Sease

[57] ABSTRACT

A two step process for the obtainment of white oils, using hydrocarbons which are heavy alkylates obtained as a by product in the manufacture of detergent range linear alkylbenzene (9–15 carbon atom paraffin chains) as the raw material is described.

The first step consists of pretreatment (of an absorbent nature) of the feed, with an activated magnesium silicate in order to eliminate the heaviest components. In a second stage, the resulting treated product acts as a feed in a hydrogenation process to produce white oils, in a presence of a hydrogenation catalyst formed by a metallic component of the group of iron and/or nickel upon a refractory inorganic oxide support.

The catalytic hydrogenation process is carried out in a fix bed reactor with down flow.

It is useful in the pharmaceutical and food industries.

8 Claims, No Drawings

TWO STEP PROCESS FOR THE OBTAINMENT OF WHITE OILS

OBJECT OF THE INVENTION

This invention relates to the conversion of hydrocarbons to white oils and, especially the hydrogenation of a flow of a byproduct consisting of heavy alkylate hydrocarbons, by means of a two step process in order to produce white oils.

The alkylation of benzene with an olefin or other hydrocarbons with a large linear chain to produce for example, linear alkylbenzene and dodecylbenzene has become a common and useful process in the conversion of hydrocarbons. The main products obtained by this process are useful, for example, as basic intermediates in the production of synthetic detergents. A byproduct of this alkylation process is a heavy alkylate flow. This flow is used generally as a thermal oil for heat exchange and is sold as a lubricant base for all types of machines.

On the other hand, white oils are high value hydrocarbonated products which are useful as lubricants, in the pharmaceutical industry, as an insecticide support vehicle, as thermal fluids, in food, etc.

The present invention describes a novel two step process which is capable, first of treating and then hydrogenating, a flow of the low value heavy alkylated byproduct in order to give a high value white oil product. The process is improved because the first treatment step is critical to eliminate the heaviest components of the feed which could, otherwise, deactivate the hydrogen catalyst used subsequently in this invention, as well as reduce the quality of the white oil obtained.

BACKGROUND OF THE INVENTION

The production of white oils by hydrogenation of different types of raw materials coming from oil is well known and is used normally commercially.

U.S. Pat. No. 3,328,293 describes a process . for the production of white oils from the distillation of mineral oil which contains aromatic compounds naphthalenes and paraffins. The process consists of catalytic hydrogenation, using a sulfur resistant catalyst, which converts the strongly polar compounds into apolar ones, increasing the naphthalene and paraffin content of said distillate. Subsequently, this distillate is subjected to fractionation, in a silica gel or aluminum oxide absorption column to separate a paraffin hydrocarbon fraction and another naphthalene hydrocarbon fraction useable as white oil.

The use of an alkylate fraction which contains sulfur, with a boiling point above the range of gasoline, with a useful feed for a process of obtainment of white oil is referred to in U.S. Pat. No. 3,392,112. Bascially, this is a two step process for the elimination of sulfur and aromatic compounds, in which the first step consists of catalytic hydrogenation with a sulfur resistant catalyst, which yields a partially hydrogenated product with a low sulfur content so that it does not adversely affect the nickel catalyst and diatomaceous catalyst of the second step. This second hydrogenation is carried out at a pressure less than 2,500 psi and other suitable conditions to give a useful product such as white oil.

Among other patents which partially or totally describe the raw material of the present invention, U.S. Pat. 4,240,900 and Spanish patent No. 548,767 are included.

The hydrogenation processes for the production of white oils which use as a catalyst a metal from the iron group on an inorganic oxide refractory support are also known in literature. For example, Spanish patent No. 548,767 describes the use of a hydrogenation catalyst which comprises a metal of Group VIII especially platinum or nickel, upon a porous inorganic support for the production of white oils. However, this Spanish patent claims the use of a catalyst which contains only 5% to 20 % by weight of the metallic component. U.S. Pat. No. 3,658,692 describes a process for the production of white oil by hydrogenation of a white oil base, with a low sulfur content, in the presence of a catalyst which contains nickel, cobalt and/or iron, with an alumina, silica-alumina or boron base and where the catalyst is prepared in a specific manner. A hydrogenation catalyst which contains from 25% to 75% by weight of a metallic component of Group VIII, is described in U.S. Pat. No. 4,318,829. The described hydrogenation catalyst also includes aluminum and one or more metallic components of Group IIa, upon porous particles, with a catalyst characterized by having a BET surface area of 150–350 $m^2/g$.

Likewise, the use of a two step hydrogenation process for the production of white oils is well known. However, the described two step processes, either refer to the use of two reaction areas, the first one of hydrotreatment and then a second one of hydrogenation, as in U.S. Pat. No. 3,431,198, or else they describe a process which comprises two successive hydrogenation steps, such as U.S. Pat. No. 3,392,112 cited above.

There are many other patents which describe similar processes of catalytic hydrogenation of heavy hydrocarbons for the obtainment of white oils, but the process object of the present invention differs from the ones presently existing, in that the first step of the same is strictly a pretreatment step of the feed, which does not consist of any catalytic hydrogenation process, but rather a treatment of absorption with selective elimination of the heaviest components, while the second step is a more or less conventional type hydrogenation.

Consequently, it is an object of the present invention to provide an improved process for the obtainment of white oils from heavy alkylates.

Another object of the present invention is the furnishing of a process for the obtainment of white oils from heavy alkylates, in which a first step or selective pretreatment is used, consisting of percolation of the heavy alkylate through a bed of activated magnesium silicate, which furnishes important advantages in comparison with the normal methods and use, a first step of a substantially different nature and generally a more complicated and more costly process of catalytic hydrogenation.

Other objects and advantages of the invention will be inferred from the following description.

DESCRIPTION OF THE INVENTION

The present invention lies in a two step process for the catalytic hydrogenation of a stream of the heavy alkylate byproduct, to produce white oils from hydrocarbons, as a result the yield and features of the hydrogenation catalyst used are improved. The process includes the following steps:

(a) passing of a flow of the heavy alkylate byproduct, suitable for production of white oils into a treatment area operating under treatment conditions and which contains an absorbent capable of eliminating the heaviest hydrocarbon components, as well as producing a flow of the treated heavy alkylate byproduct;

(b) passing of the flow of the treated heavy alkylate byproduct into a hydrogenation reaction area, operating under the hydrogenation reaction conditions and which contains a hydrogenation catalyst which includes a metallic component of the iron group, upon a refractory oxide support, to produce a white oil product and (c) recovering of the white oil product obtained in step (b).

The white oils such as the ones produced by the process of the present invention are highly refined oils derived from oils, which have been extensively treated to be free of oxygen, nitrogen, sulfur compounds and reactive hydrocarbons such as aromatic hydrocarbons.

The white oils may be of two types: (1) technical white oils which are used in cosmetics, textile lubrication, insecticide base oils, thermal fluids, co-adjuvants in the tanning industry, etc. and (2) pharmaceutical white oils, even more highly refined than the previous ones, which are used in drug compositions, foods, for the lubrication of food manufacturing machinery. For all these uses the white oils must be chemically inert and colorless, odorless and tasteless. For this reason, the white oils must be essentially free of reactive matter such as aromatic and olefin components and must comply with strict specifications. The specifications of white oils are rather difficult to comply with, since such oils must have a color of +30 Saybolt and must pass the UV absorption (ASTM D-2008) test and the hot acid (ASTM D-565) test.

The process of the present invention is capable of producing a product which complies with or exceeds the above specifications, for technical grade as well as pharmaceutical grade white oils.

The raw material useful in the process of this invention may be any of the ones known and cited in literature which are capable of being hydrogenated for producing white oils. Such raw materials include, but are not limited to lubricating oils distillates, transforming oil bases, paraffin bases, white oils bases, mineral oils derived from crude oils and the like. Generally, such useful products have a boiling point from 200° C. to 600° C. or higher. The feed viscosity may be in the range from 30SSU to 2,500 SSU at 40° C. Besides, the feed can contain sulfur, nitrogen compounds and heavy polynuclear aromatic compounds.

The preferred feed for the process of this invention consists of a flow of the heavy alkylate byproduct, coming from an aromatic alkylation process. This product flow typically contains aromatic and paraffin compouunds with a number of 10 to 100 carbons and, preferably, in the range of 15 to 50 carbon atoms. Aside from the components mentioned above, this feed stream may contain olefins.

In accordance with this invention, it is a specially preferred embodiment that the flow of the heavy alkylate byproduct useful as a feed flow comprises a feed of essentially sulfur free hydrocarbon, basically made up of aromatic type compounds, with a molecular proportion which includes from 20–25% by weight of an aromatic type compound and 50–80% by weight of a paraffin type component. Besides, the flow contains heavy aromatic compounds which are not easily hydrogenated in the normal process and which are, thus, separated in the important and critical step of pretreatment of the feed of this process.

The hydrogenation catalyst used in the second step of the process of the present invention can be any catalyst described in the art which has a hydrogenation function. A well-known and preferred type of catalyst for its use in this invention consists of one or more metals of the iron group, upon a catalytic support. The support may be formed by a refractory material such as alumina, or an active material such as crystalline aluminosilicate. The metals of the iron group suitable for use in this process are iron, cobalt and nickel.

A particularly preferred hydrogenation catalyst is the one made up of 20% to 70% by weight of a metallic component of the iron group and/or nickel, combined with an non-acidic refractory inorganic oxide such as alumina. Although the exact type of preparation of the catalytic compound is not an essential characteristic of the present invention it is, preferable that the scheme of preparation selected gives that is rise to a catalyst particile in which the metal of the iron group, catalytically active, is well dispersed in the particle of the catalyst. The catalyst used in this process is not regenerated and is discarded after its use.

In a representative process of this invention, the obtainment of white oils is obtained by means of two successive steps: a pretreatment of the feed and a subsequent hydrogenation of the pretreated product obtained in the previous step.

Given that the preferred raw material used is a flow of a the heavy alkylate byproduct coming from distillation of a linear alkylbenzene and the latter contains all the residue coming from said distillation, the hydrogenation catalyst used subsequently would not act adequately if a crude heavy alkylate were used as a feed without prior pretreatment. This is due to the difficulty in saturating heavy aromatic compounds which are found in the heavy alkylate. To eliminate this problem and be able to conventionally effect the hydrogenation in a single run, according to the present invention, a step prior to said hydrogenation is used, which consists of percolation of the heavy alkylate through an activated fibrous hydrated magnesium silicate bed.

The percolation is carried out at atmospheric pressure and at temperatures between 30° and 100° C. using the silicate previously activated at a temperature between 150° and 500° C. and, preferably, between 200° and 400° C.

In general, the aromatic and unsaturated products with a higher molecular weight, which are normally recovered from said silicate are retained in this percolation, the silicate being discarded once those undesirable heavy compounds have been saturated. The treated heavy alkylate flow is used for the subsequent catalytic hydrogenation of the second step of the process.

The hydrogenation reaction is carried out in a fixed bed reactor with down flow and using a system of parallel streams for the heavy alkylate and for the hydrogen. The hydrogenation reaction takes place in liquid phase and continuously by means of a single run.

According to this invention the hydrogen is a cofeed for the hydrogenation reaction area. The hydrogen is contacted with the heavy alkylate byproduct in this reaction area. The hydrogen feed/heavy alkylate byproduct molar ratio can vary from approximately 1 to 100, a preferred value being from about 5 to 20. Besides, the hydrogenation of the heavy alkylate can take place in hydrocarbon conversion conditions which include a temperature from 150° to 500° C., a pressure of 34 to 136 atmospheres and a liquid hourly space velocity (calculated upon the base of the amount of heavy alkylate volume loaded to the hydrogenation area by hour, divided by the volume of the catalyst used) in the range of approximately 0.05 to about 5 hr-1. However, the conditions of the hydrogenation process of this invention are typically low in severity, since the hydrogenation process of the present invention is preferably carried out with a heavy alkylate which essentially does not contain sulfur. The preferred conditions of the hydrogenation process include a temperature from 175° to 300° C., a pressure from 68 to 136 atmospheres and a liquid hourly space velocity from 0.05 to o.5 hr-1.

An advantage of the present invention lies in a two step process for obtainment of white oils, in which the first step consists of a pretreatment (of an absorbent type) of the feed, which makes an improvement in the yield and features of the hydrogenation catalyst used in the final step possible.

The normal process of manufacturing of white oils often includes a prior step of catalytic desulfuration and/or partial catalytic hydrogenation, in which a catalyst of a different nature from the one used in the second step of catalytic hydrogenation itself is used, for the purpose of obtaining a feed with some adequate features and in order not to damage the catalyst used afterwards. This previous hydrogenation step makes these processes complicated and more expensive when they are compared with the process of the present invention, in which an alternative pretreatment of a non-hydrogenating nature is used, which both simplies and cheapens the process, at the same time that it makes it possible to use raw materials that contain moderate residual amounts of aromatic and unsaturated compounds of high molecular weight. These high molecular weight components generally have difficulty of hydrogenation with the processes and catalysts normally used. This is another advantage of the present invention.

Another advantage of the present invention is that the process making it possible to obtain a high value white oil product from a low value raw material, such as a flow of the heavy alkylated byproduct, coming from distillation of detergent range linear alkylbenzenes, this product is used in the manufacture of biodegradable synthetic detergents.

Finally, another advantage of the present invention in comparison with other similar competitive processes is the possibility of obtaining aside from the normal products (technical white oils) other high quality products, such as pharmaceutical white oils, which must comply with very strict specifications which are generally difficult to meet.

The process of this invention described above will hereafter be illustrated in some specific examples which, however, do not limit this invention.

EXAMPLES

Example 1

The process described in the present invention is applied to a linear heavy alkylbenzene in order to obtain a white oil which complies with or exceeds the specifications of the FDA, for both the technical and commercial grades, as well as for the medical or pharmaceutical grades.

The raw material used as a feed consists of a flow of a $C_{10}$–$C_{14}$ detergent range linear heavy alkylbenzene byproduct, basically made up of dialkylbenzene and obtained as a byproduct of a process to produce linear monoalkylbenzene of an identical range, used as a basic intermediate in the biodegradable synthetic detergents industry. Its features and composition (obtained by CGMS) are specified in detail in Table I.

TABLE I

| PROPERTIES | TYPICAL VALUE |
|---|---|
| Density; 15° C. | 0.8820 |
| Bromine number | 5 |
| Gardner color | 4–5 |
| Water, ppm. | <50 |
| Sulfur | <1 |
| Viscosity, cSt, 50° C. | 22.3 |
| Viscosity, °E, 40° C. | 3.1 |
| Freezing point, °C. | <−40 |
| Aniline point, °C. | 67 |
| Average molecular weight | 370 |
| Distillation, °C. | |
| Initial | 320 |
| 50% | 369 |
| Final | 398 |
| COMPOSITION | % BY WEIGHT |
| Dialkylbenzene | 88.43 |
| Diphenylaklanes | 7.16 |
| Anthracene derivatives | 2.09 |
| Indans, tetralines and triphenylalkanes | 1.67 |
| Light alklate (alkylbenzene) | 0.65 |

In a first step the feed is subjected to a percolation by means of an activated fibrous hydrated magnesium silicate, carried out at atmospheric pressure and a temperature of 40° C. A large part of the aromatic and unsaturated products of higher molecular weight which are the most difficult ones to hydrogenate in the subsequent step remain retained.

This reduction of the content of high molecular weight aromatic products can be observed by the reduction of the Gardner color, which goes from a typical value of 4–5 to another one of 1 or 2 in the final pretreated product, with the subsequent reflection in the reduction of the UV absorption of said product.

A catalytic hydrogenation reaction of the pretreated feed is effected in a second step. This is carried out continuously in a tubular pressure fixed bed and down flow reactor. The reactor is made of carbon steel with a useful volume of 250 cc and an inside diameter of 32.4 mm. and is provided with adequate pressure, flow and temperature control mechanisms. The catalyst which is put in the form of a fixed bed is inserted in this reactor. The catalyst used is Girdler type G–49B. with a nickel content of 50–55% by weight, upon a carbon support. It is formed in a granular form and its grain size is from 1–1.68 mm.

The hydrogenation reaction takes place in liquid phase upon contacting the two streams formed, one by the heavy alkylate and the other by hydrogen by means of a system of parallel streams.

The reaction conditions are summarized in Table II hereinafter.

TABLE II

| | |
|---|---|
| Hydrogen/pretreated heavy alkylbenzene molar ratio | 6.28 |
| Pressure | 75 kg/cm$^2$ |
| Temperature | 200° C. |
| Space velocity | 0.15 hr-1 |
| No. of treatments | 3 |

The average consumption of hydrogen per kilogram of heavy alkylate can be estimated as 16 grams.

The final reaction product obtained can be the result of a single or sole catalytic hydrogenation treatments, according to the conditions of the process chosen and likewise depending on the desired and/or required features from the white oil product resulting from the process. In the event of carrying out several treatments, they are effected by successive passings of the corresponding reacting products through the hydrogenation reactor.

For the more refined and higher quality white oils, pharmaceutical grade oils, the critical specification most difficult to comply with is the one concerning their content in cabonizable substances comparable with their content in aromatic compounds. This parameter can be effectively controlled by means of determining the ultraviolet absorption at 272 nm, as is done in the examples of the process of the present invention. Hence, the great importable of the elimination of the feed, as much as possible, from the aromatic and unsaturated compounds of higher molecular weight and more difficult to hydrogenate, given the high contribution to the absorbancy of the final product obtained, due to the high extinction coefficients is inferred.

The results shown in Table III were obtained in the cited reaction conditions.

TABLE III

| | |
|---|---|
| UV absorbancy, 272 nm (aromatics) | 0.05 units |
| Density, 15° C. | 0.8595 |
| Viscosity, cSt, 40° C. | 39.9 |
| Carbonizable substances | it complies with the specifications (for a pharmaceutical white oil) |
| Color | it complies with the specifications (for a pharmaceutical white oil) |
| Neutrality | it complies with the specifications (for a pharmaceutical white oil) |

According to the process described in this example of the present invention, an oil which complies with all the specifications required by the FDA for better quality and more expensive oils, classified as pharmaceutical or medicinal degree oils is obtained.

From the point of view of the advantages and improvements introduced by including in the process of this invention, the pretreatment step (of absorbent nature) of the feed, it is interesting to point out that for processes totally similar to the one described in this example, but effected without applying this pretreatment, we have obtained white oil products with higher values of absorbancy (more than three units) which do not comply with the specifications required for high quality pharmaceutical grade white oils.

EXAMPLE 2

The process described in the present invention is applied to a detergent range linear heavy alkylbenzene to obtain a white oil which complies with the specifications for a technical or commercial quality oil, as well as a pharmaceutical quality oil.

The process followed and the conditions used are the ones described in example 1 with the following exceptions: the pressure of the catalytic hydrogenation reaction has a value of 100 kg/cm$^2$ and the number of treatments effected is 2.

The results obtained are shown in Table IV.

TABLE IV

| | |
|---|---|
| UV absorbancy, 272 nm (aromatics) | 0.13 units |
| Density, 15° C. | 0.8623 |

TABLE IV-continued

| | |
|---|---|
| Viscosity, cSt, 40° C. | 48.6 |
| Carbonizable substances | it meets the requirements |
| Color | it meets the requirments |
| Neutrality | it meets the requirments |

EXAMPLE 3

The process described in this invention is applied to a $C_{10}$-$C_{14}$ detergent range linear heavy alkylbenzene to obtain a white oil for both technical as well as pharmaceutical or medicinal uses.

The process followed and the conditions used are all identical to the ones described in Example with with the following exceptions: in the catalytic hydrogenation reaction the pressure is 100 kg/cm$^2$ and the temperature is 220° C. Besides, the white oil obtained is the result of a sole treatment or passing through the hydrogenation reactor of the second step.

The results obtained under these conditions are shown in Table V.

TABLE V

| | |
|---|---|
| UV absorbancy, 272 nm (Aromatics) | 0.65 units |
| Density, 15° C. | 0.8644 |
| Viscosity, cSt, 40° C. | 47.6 |
| Carbonizable substances | it complies with the specifications |
| Color | it complies with the specifications |
| Neutrality | it complies with the specifications |

What is claimed:

1. A two step process for obtaining white oils of technical and pharmaceutical degree from heavy alkylate oils often obtained as by-product from production of detergent linear alkylbenzenes, said process comprising;
   (a) pre-treating said heavy alkylates with an activated fibrous hydrated magnesium silicate to reduce heavy aromatic components; and thereafter,
   (b) hydrogenating the pretreated alkylates to provide white oils of a technical and pharmaceutical degree.

2. The process according to claim 1 wherein said pretreating with an activated fibrous hydrated magnesium silicate is accomplished at an activating temperature between 100° C. and 500° C.

3. The process of claim 2 wherein said pretreatment is by percolating said heavy alkylated oil through said activated fibrous hydrated magnesium silicate at atmospheric pressure and at a temperature within the range of from about 30° C. to about 100° C.

4. The method of claim 2 wherein the absorbent is activated at a temperature within the range of from about 200° C. to about 400° C.

5. The method of claim 3 wherein said percolation is at a temperature within the range of from about 30° C. to about 50° C.

6. The process of claim 2 wherein the absorbent is sepiolite.

7. The process of claim 8 wherein hydrogenation is accomplished by passing the pre-treated heavy alkylate oils into a hydrogenation reaction area of a fixed bed reactor operating with a hydrogen feed to heavy alkylate oil molar ratio of from 1 to 100, and said reactor is operating at a temperature within the range of from about 150° C. to about 500° C., at a pressure of from about 34 to about 136 atmospheres, and at a liquid hourly space velocity of from about 0.05 to 5.0 hr-1, in the presence of a hydrogenation catalyst which includes a metallic component selected from the group of iron and nickel, with said metallic components being supported on a refractory oxide support.

8. The process of claim 7 which includes as a final step recovery of the white oil product.

* * * * *